US007806714B2

(12) United States Patent
Williams et al.

(10) Patent No.: US 7,806,714 B2
(45) Date of Patent: Oct. 5, 2010

(54) PUSH-PULL CONNECTOR

(75) Inventors: Brian Williams, York, PA (US); William Lenker, Maryville, PA (US); Kasthuri Damodharan, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/269,435

(22) Filed: Nov. 12, 2008

(65) Prior Publication Data

US 2010/0120282 A1 May 13, 2010

(51) Int. Cl.
*H01R 13/627* (2006.01)

(52) U.S. Cl. ..... 439/352; 439/265

(58) Field of Classification Search ..... 439/352, 439/265, 255

See application file for complete search history.

(56) References Cited

U.S. PATENT DOCUMENTS

| | | | | |
|---|---|---|---|---|
| 3,430,184 | A | 2/1969 | Acord | |
| 3,452,316 | A | 6/1969 | Mocek et al. | |
| 3,723,944 | A * | 3/1973 | Gauchat et al. | 439/255 |
| 4,548,455 | A * | 10/1985 | Ezure | 439/152 |
| 4,941,846 | A | 7/1990 | Guimond et al. | |
| 4,954,097 | A * | 9/1990 | Sekiguchi | 439/352 |
| 5,167,522 | A | 12/1992 | Behning | |
| 5,569,053 | A * | 10/1996 | Nelson et al. | 439/668 |
| 5,595,499 | A | 1/1997 | Zander et al. | |
| 5,785,545 | A | 7/1998 | Holt | |
| 6,267,612 | B1 | 7/2001 | Arcykiewicz et al. | |
| 6,290,525 | B1 | 9/2001 | Jacobi | |
| 6,361,348 | B1 | 3/2002 | Hall et al. | |
| 6,517,373 | B2 * | 2/2003 | Finke et al. | 439/352 |
| 6,619,876 | B2 | 9/2003 | Vaitkus et al. | |
| 6,692,285 | B2 | 2/2004 | Islam | |
| 6,749,454 | B2 | 6/2004 | Schmidt et al. | |

(Continued)

FOREIGN PATENT DOCUMENTS

DE 10121675 A1 11/2001

(Continued)

OTHER PUBLICATIONS

"Snap-Lock SMA Series"; Tyco Electronics; Copyright 2007; 4 Pgs.

(Continued)

*Primary Examiner*—Neil Abrams

(57) ABSTRACT

A connector assembly configured to engage a mating connector. The connector assembly includes a plug body that has loading and mating ends and a central axis extending therebetween. The mating end is configured to be inserted into a cavity of the mating connector to establish at least one of communicative and power connections. The plug body has an outer surface that surrounds and faces away from the central axis. The connector assembly also includes a ring that is slidably mounted over the plug body. The ring is configured to slide along the outer surface of the plug body in an axial direction between withdrawn and locked positions. The connector assembly also includes a sleeve member that is slidably mounted over the plug body and the ring. The sleeve member includes a plurality of fingers that extend toward the mating end and are biased toward the outer surface of the plug body. The ring is configured to engage the fingers and the fingers are configured to flex away and engage the mating connector.

20 Claims, 7 Drawing Sheets

U.S. PATENT DOCUMENTS

| | | | |
|---|---|---|---|
| 6,769,926 | B1 | 8/2004 | Montena |
| 6,848,931 | B2 | 2/2005 | McMullen et al. |
| 6,884,105 | B2 | 4/2005 | Turck et al. |
| 7,229,303 | B2 | 6/2007 | Vermoesen et al. |
| 7,238,047 | B2 | 7/2007 | Saettele et al. |
| 2004/0219834 | A1 | 11/2004 | Vielhaber |
| 2006/0033218 | A1 | 2/2006 | Hafner et al. |
| 2006/0051999 | A1 | 3/2006 | Allemann et al. |
| 2007/0293076 | A1 | 12/2007 | Fehling et al. |

FOREIGN PATENT DOCUMENTS

| | | | |
|---|---|---|---|
| DE | 10235675 | A1 | 5/2003 |
| DE | 20 2005 009 396 | | 10/2006 |
| DE | 10 2005 057444 | | 3/2007 |
| DE | 102006012194 | A1 | 9/2007 |
| DE | 10 2007 009947 | | 9/2008 |
| EP | 1 282 202 | | 2/2003 |
| EP | 1 603 200 | | 12/2005 |
| EP | 01686660 | A2 | 8/2006 |
| FR | 2 479 580 | | 10/1981 |
| WO | WO-2007/062845 | A1 | 6/2007 |

OTHER PUBLICATIONS

"M12 quick-connect technology"; TURCK Industrial Automation; Copyright 2007; 1 Pg.

European Search Report, European Application No. 09158135.5-2214 European Filing Date Aug. 17, 2009.

International Search Report, International Application No. PCT/US2009/006015, International Filing Date Jun. 11, 2009.

* cited by examiner

PUSH-PULL CONNECTOR

CROSS-REFERENCE TO RELATED APPLICATIONS

The present application includes subject matter that is similar to subject matter disclosed in U.S. patent application Ser. No. 12/104,551, filed Apr. 17, 2008, which is incorporated by reference in the entirety. The application also includes subject matter disclosed in U.S. patent application Ser. No. 12/269,469, filed Nov. 12, 2008, and is incorporated by reference in the entirety.

BACKGROUND OF THE INVENTION

The invention relates generally to connectors, and more particularly to push-pull type connectors.

Push-pull type connectors may provide a quick method for establishing a communicative and/or power connection between systems and devices. Push-pull type connectors may be female such that a mating connector is received within a cavity of the female push-pull connector. The mating connector typically has threads projecting radially outward that are engaged by the push-pull connector. Push-pull connectors may also be male where the mating connector has a cavity that receives the male push-pull connector. When the push-pull connector is male, the mating connector typically includes threads that project radially inward into the cavity and are configured to be engaged by the male push-pull connector.

In one known male push-pull type connector, the push-pull connector has a cylindrical body that is configured to be inserted into a cavity of a mating connector. The cavity is defined by a cylindrical wall that includes threads formed along a surface of the wall and project radially inward. The push-pull connector includes a cylindrical plug body having a mating end that is inserted into the cavity. The plug body is partially surrounded by separate segments where each segment extends along the plug body in an axial direction. The segments are made of a compressible material and have threads that project radially outward proximate to the mating end. The segments are separated from each other by gaps. The push-pull connector also includes sliding members that are movable in the axial direction along the gaps. To engage the push-pull connector and the mating connector, the plug body is inserted and advanced into the cavity. When the plug body is fully inserted into the mating connector, the sliding members slide along the plug body. Portions of each sliding members slide underneath the adjacent segments near the mating end. The segments are pushed radially outward and press against the inner threads of the cavity.

However, in order for the push-pull connector described above to form an appropriate interference fit with the mating connector, the segments require a certain size and thickness of the compressible material. The resulting size of the push-pull connector may not satisfy certain industry standards. Also, the gaps that separate the segments reduce an amount of available material for engaging the threads. In addition, the compressible material may not provide electrical shielding for the connection.

Accordingly, there is a need for a push-pull connector that forms an environmental seal and/or an electrical shield while satisfying predetermined requirements. Furthermore, there is a need for a male push-pull connector that may be constructed in a less costly manner than other known connectors.

BRIEF DESCRIPTION OF THE INVENTION

In one embodiment a connector assembly that includes a plug body that has loading and mating ends and a central axis extending therebetween. The mating end is configured to be inserted into a cavity of a mating connector to establish at least one of communicative and power connections. The plug body has an outer surface that surrounds and faces away from the central axis. The connector assembly also includes a ring that is slidably mounted over the plug body. The ring is configured to slide along the outer surface of the plug body in an axial direction between withdrawn and locked positions. The connector assembly also includes a sleeve member that is slidably mounted over the ring. The sleeve member includes a plurality of fingers that extend toward the mating end and are biased inward toward the outer surface of the plug body. The ring engages the fingers when moved from the withdrawn position to the locked position causing the fingers to flex outward away from the outer surface and engage the mating connector.

Optionally the sleeve member may be slidably coupled to the ring and capable of slightly rotating about the longitudinal axis when the fingers engage the wall surface of the mating connector. Also, each finger may include at least one thread element that projects radially outward. The at least one thread element may be configured to engage the mating connector. In addition, the sleeve member may be stamped and formed from a common piece of sheet material.

In another embodiment, a connector assembly is provided that includes a plug body having loading and mating ends and a central axis extending therebetween. The mating end is configured to be inserted into a cavity of a mating connector to establish at least one of communicative and power connections. The plug body has an outer surface and a ridge that projects radially outward from the outer surface. The connector assembly also includes a sleeve member that is mounted over the plug body. The sleeve member includes a plurality of fingers that extend in the axial direction along the outer surface of the plug body and toward the mating end. Each finger extends over the ridge and includes a base portion on one side of the ridge that is proximate to the loading end and a lever portion on another side of the ridge that is proximate to the mating end. The connector assembly also includes a ring that is slidably mounted over the sleeve member. The ring is configured to slide along the sleeve member in the axial direction between withdrawn and locked positions. The ring compresses the base portions of the fingers toward the outer surface of the plug body when moved from the withdrawn position to the locked position. The fingers pressing against the ridge causes the lever portions of the fingers to flex away from the outer surface and engage the mating connector.

Optionally, the base portion of each finger may project away from the outer surface of the plug body as the base portion extends in the axial direction. Also, the lever portion directly abuts the outer surface of the plug body when the ring is in the withdrawn position.

DETAILED DESCRIPTION OF THE INVENTION

Figure 1:
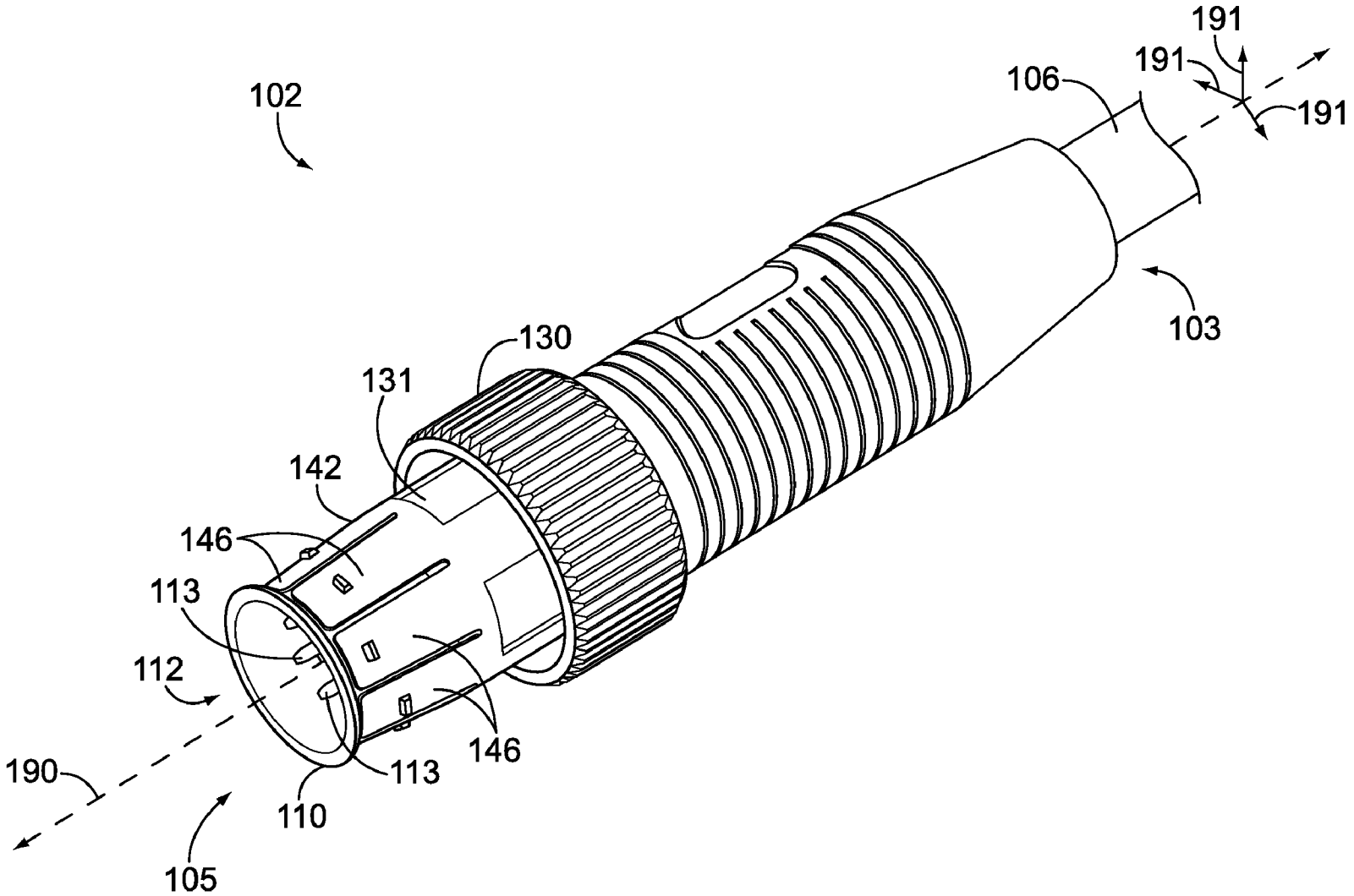
FIG. 1 is a perspective view of a connector assembly formed in accordance with one embodiment.

FIG. 1 is a perspective view of a connector assembly 102 formed in accordance with one embodiment. The connector assembly 102, which may also be referred to as a push-pull connector or first connector may be used to connect a cable assembly 106 to a mating connector 104 (shown in FIG. 2), which may also be referred to as a second connector. In FIG. 1, the connector assembly 102 is disengaged from the mating connector 104. The connector assembly 102 may have a substantially linear structure that extends between a loading end 103 and a mating end 105 and may extend along a longitudinal or central axis 190. The mating end 105 is configured to be inserted into a cavity 208 (shown in FIG. 2) of the mating connector 104 to establish at least one of a communicative and power connection. The communicative connection may be an electrical and/or fiber optic connection. When fully engaged, the connector assembly 102 and the mating connector 104 may form at least one of an environmental seal and an electrical shield.

As shown in FIG. 1, the connector assembly 102 may include a plug body 110 that has an outer surface 111 (shown in FIG. 5), a sleeve member 142 that surrounds the plug body 110, and a collar 130 that surrounds the sleeve member 142. The connector assembly 102 may also include a boot 107 that is coupled to the loading end 103 of the plug body 110. The plug body 110 may have a substantially cylindrical structure and also extend along the longitudinal axis 190. In the illustrated embodiment, the plug body 110 houses a plurality of mating contacts 113 within a cavity 112. Alternatively, the plug body 110 may include a dielectric insert that includes contact channels with mating contacts held therein. The collar 130 may include a ring 131 that is slidably mounted over the plug body 110 and is configured to slide between a withdrawn position (shown in FIG. 1) to a locked position (shown in FIG. 6). As will be discussed in greater detail below, the sleeve member 142 includes a plurality of fingers 146 that extend toward the mating end 105 and are biased toward the outer surface 111 of the plug body 110. When the ring 131 is moved from the withdrawn position to the locked position, the ring 131 engages the fingers 146 of the sleeve member 142 causing the fingers to flex away from the outer surface 111 and press against and engage an inner surface 218 (shown in FIG. 2) of the mating connector 104.

It is to be understood that the benefits herein described are also applicable to other connectors and connector assemblies. For example, in the illustrated embodiment, the connector assembly 102 is a male connector and the mating connector 104 is a female connector. However, those skilled in the art understand that male connectors may have female parts in addition to the male parts, e.g., the cavity 112 of the connector assembly 102. Likewise, female connectors may have male parts, e.g., a plug insert 220 (shown in FIG. 2). Also, although the illustrated embodiment of the connector assembly 102 is a linear push-pull type connector, alternative embodiments of the connector assembly 102 are not required to be a push-pull type or have a linear structure. For example, the connector assembly 102 may be a push-pull type connector that has a right-angle structure. Furthermore, the connector assembly 102 may include other components and perform other operations, such as those described in U.S. patent application Ser. No. 12/104,551, filed Apr. 17, 2008, or those described in U.S. patent application Ser. No. 12/269,469, filed Nov. 12, 2008, filed contemporaneously herewith, both of which are incorporated by reference in the entirety. As such, the following description is provided for purposes of illustration, rather than limitation.

Figure 2:
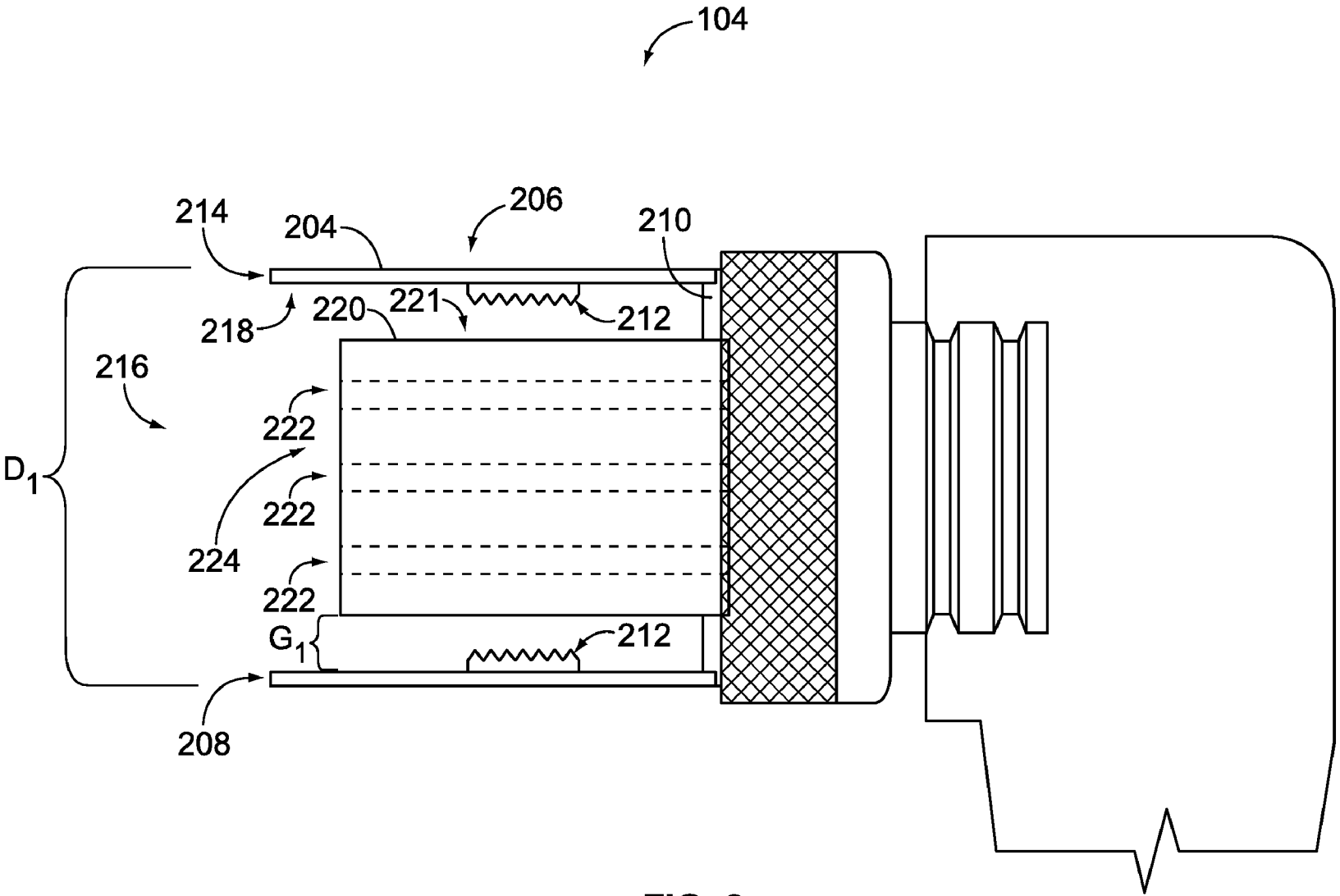
FIG. 2 illustrates a partial cross-sectional view of a mating connector that is configured to engage the connector assembly shown in FIG. 1.

FIG. 2 illustrates a partial cross-sectional view of the mating connector 104. The mating connector 104 may include a stem wall 204 that defines a cavity 208. The cavity 208 is configured to receive the mating end 105 (FIG. 1) of the connector assembly 102 (FIG. 1). The stem wall 204 has an outer wall surface 206 and an inner surface 218 and nay include a front edge 214 that defines an opening 216 to the cavity 208. The cavity 208 may have a cross-section that is suitable to receive the mating end 105 (e.g., circular or square) and may extend substantially along the axial direction (i.e., along the longitudinal axis 190 when the connector assembly 102 and the mating connector 104 are engaged). The opening 216 has a diameter $D_1$. The mating connector 104 may also have a contact base 210 at a rear end of the cavity 208. The contact base 210 may function as a positive stop when the plug body 110 (FIG. 1) is inserted into the cavity 208. The contact base 210 may be formed from a compressible material (e.g., rubber or plastic) or include a separate o-ring in order to form an environmental seal for the connection extending therethrough.

In the illustrated embodiment, the surface 218 may include a plurality of threads 212 that project radially inward (i.e., in a direction that is toward the central axis 190). The axes 191 shown in FIG. 1 indicate a radially outward direction. The threads 212 extend around or encircle the inner surface 218. The threads 212 may extend partially or completely around the wall surface 206 and may extend along a portion of the inner surface 218 in the axial direction as shown in FIG. 2. Alternatively, the threads 212 may extend entirely through the cavity 208 from proximate to the front edge 214 to proximate to the contact base 210. In the illustrated embodiment, the threads 212 are configured to engage the fingers 146 (FIG. 1) when the connector assembly 102 and the mating connector 104 are engaged. However, in alternative embodiments, the surface 218 may include other features, such as ridges, projections, recesses, or holes that extend into or through the stem wall 204, that are configured to engage the fingers 146.

Also shown in FIG. 2, the mating connector 104 may include a plug insert 220 that is located within the cavity 208. The plug insert 220 may be formed from a dielectric material and include a plurality of contact channels 222 that are configured to receive and engage the mating contacts 113 (FIG. 1). The plug insert 220 may include a mating face 224 that faces out of the cavity 208. The plug insert 220 has an outer surface 221 and is generally shaped to be received by the cavity 112 of the plug body 110. Also shown in FIG. 2, a gap $G_1$ is defined between the outer surface 221 of the plug insert 220 and the inner surface 218 of the stem wall 204.

Figure 3:
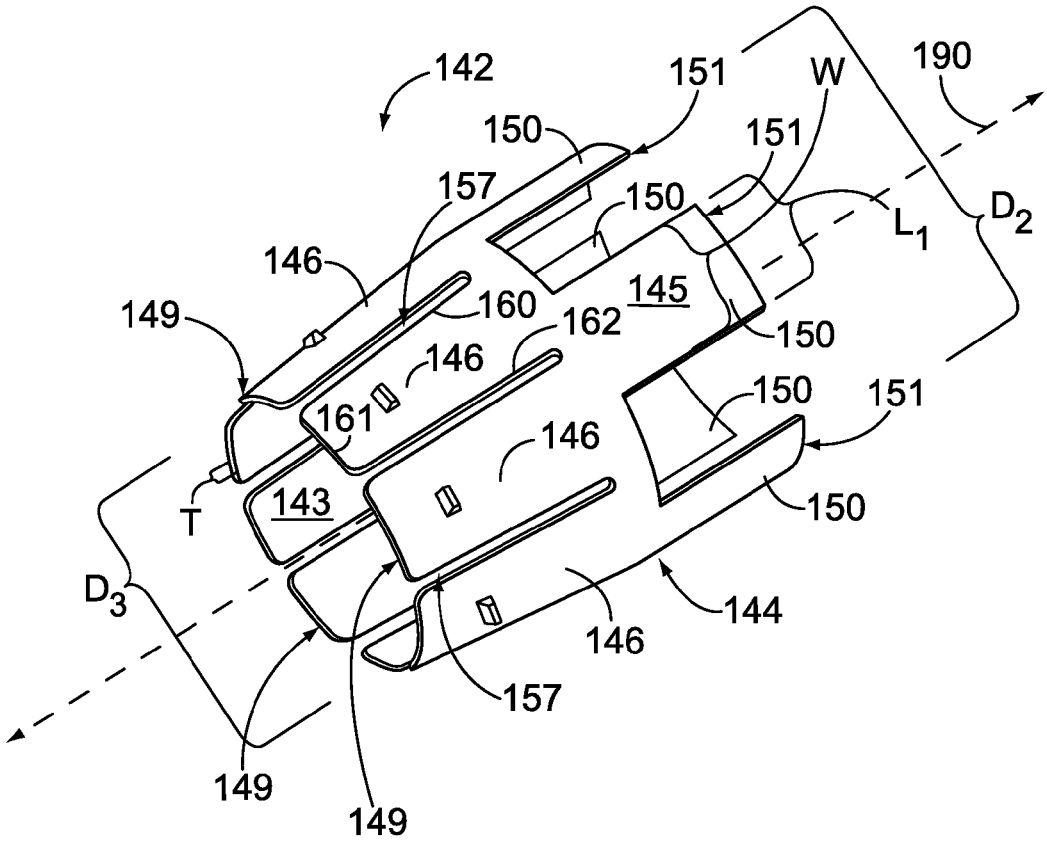
FIG. 3 is an isolated perspective view of a sleeve member that may be used with the connector assembly shown in FIG. 1.

FIG. 3 is an isolated perspective view of the sleeve member 142. When the connector assembly 102 (FIG. 1) is fully constructed as shown in FIG. 1, the sleeve member 142 surrounds the plug body 110 and extends along the plug body 110 the axial direction. The sleeve member 142 may be stamped and formed from sheet material. Alternatively, the sleeve member 142 may be machined or molded. As such, the sleeve member 142 may be defined by an inner surface 143, an outer surface 145, and a thickness T extending therebetween. As shown in FIG. 3, the sleeve member 142 may include a base portion 144 that is configured to extend around the plug body 110 (FIG. 1). The base portion 144 may have a substantially cylindrical shape. The sleeve member 142 may also include a plurality of grip members 150 that extend away from the base portion 144 and the fingers 146. When the connector assembly 102 is fully formed, the grip members 150 may extend toward the loading end 103 (FIG. 1). The grip members 150 maybe distributed around the longitudinal axis 190 and separated from each other by cut-outs 151. As such, each grip member 150 may have a width $W_1$ that has an arcuate length $L_1$. As shown in FIG. 3, the sleeve member 142 includes five grip members 150 that are evenly distributed about the longitudinal axis. However, in alternative embodiments, the sleeve member 142 may have a different number of grip members 150 and/or grip members 150 that are not evenly distributed or separated from each other. Furthermore, in alternative embodiments, the sleeve member 142 may not include grip members 150.

The fingers 146 extend along the plug body 110 toward the mating end 105 when the connector assembly 102 is fully formed. As shown in FIG. 3, the fingers 146 extend from the base portion 144 along the longitudinal 190 toward a distal end 149. The fingers 146 may be evenly distributed about the longitudinal axis 190 and separated from each other by cut-outs or slits 157. In the illustrated embodiment, each finger 146 has a substantially rectangular body having a common radius of curvature with respect to the other fingers 146. Each finger 146 may be defined by longitudinal edges 160 and 162, which extend from the base portion 144 to a common arcuate edge 161 at the distal end 149. When the fingers 146 are in a relaxed state, as shown in FIG. 3, the plurality of fingers 146 form a closed arrangement in which each finger 146 is biased toward the central axis 190.

As will be discussed in greater detail below, the fingers 146 are configured to flex radially outward (i.e., away from the plug body 110) to engage the inner surface 218 of the mating connector. In some embodiments, the slits 157 may be thin such that when the fingers 146 are flexed outwardly the fingers 146 form a substantially cylindrical structure and provide an electrical shield for the connection extending therethrough. As such, in some embodiments, the dimensions of the fingers 146 are configured to allow the fingers 146 to flex between the closed arrangement and against the wall surface 218, but have the slits 157 as thin as possible.

Also shown in FIG. 3, each finger 146 may have a thread element 148 that projects from the outer surface 145 of the finger 146 away from the central axis 190. The thread elements 148 are configured to engage or grip features, such as the threads 212 shown within the cavity 208. In the illustrated embodiment, the thread elements 148 may be teeth-like projections that extend away from the outer surface 147. Alternatively, the thread elements 148 may have other configurations, such as ridges or projections, for engaging features of the mating connector 104.

As shown in FIG. 3, each thread element 148 may have an axial position along the corresponding finger 146. In the illustrated embodiment, the thread element 148 for each finger 146 has a different axial position with respect to the axial positions of the thread elements 148 on the adjacent fingers 146.

The sleeve member 142 may be stamped and formed from a resiliently flexible material, such as a metal alloy or composite. The sleeve member 142 may also be fabricated from a plastic or other dielectric material. Furthermore, the sleeve member 142 may be manufactured by molding or machining processes. In one embodiment, the sleeve member 142, including the fingers 146 and the thread elements 148, may be stamped and formed from a common sheet of material having a substantially constant thickness throughout. In the illustrated embodiment, the teeth-like projections are embossed by pressing a mechanical device or element into one side of the sheet material. Alternatively, the thread elements 148 may be formed by bending projections that extend away from the longitudinal edges 160 or 162 radially outward. Similar thread elements are described in U.S. patent application Ser. No. 12/269,469, filed Nov. 12, 2008, which is incorporated by reference in the entirety. After the fingers 146 and thread elements 148 are stamped and formed, the sleeve member 142 may be rolled into a predetermined shape (e.g., cylindrical). Before or after rolling the sleeve member 142, the fingers 146 may be configured into the biased, closed arrangement and cured in order to maintain the biased positions while in a relaxed state.

In alternative embodiments, the fingers 146 may have other shapes and configurations. For example, the fingers 146 may include a narrower trunk that extends from the base portion 144 and gradually widens such that the fingers 146 do not touch each other at the trunks but may touch or be directly adjacent to each other at the distal ends 149 of the fingers 146. Alternatively, the fingers 146 may include wider trunks that taper as the fingers 146 extend to the corresponding distal end 149. Furthermore, the sleeve member 142 may also have a shape that is different from the cylindrical shape. For example, the sleeve member 142 may be rolled to form a square-like shape. In such an embodiment, there may be four fingers where each finger projects from one side of the square. Also, the fingers 146 may be similar to the fingers described in the aforementioned patent applications, which are incorporated by reference in the entirety.

Figure 4:
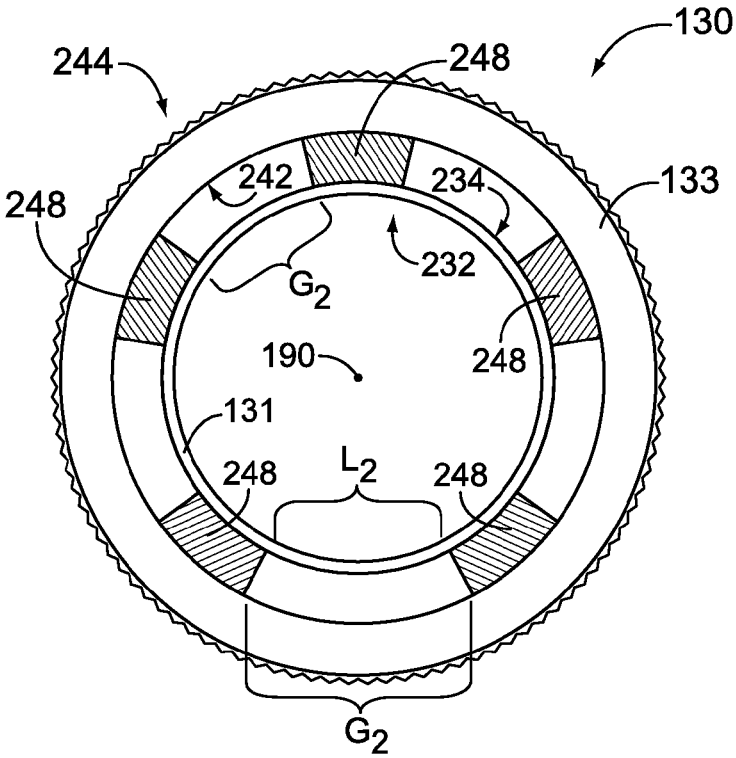
FIG. 4 is an isolated front view of a collar that may be used with the connector assembly shown in FIG. 1.

FIG. 4 is an isolated front view of the collar 130. The collar 130 includes the ring 131 and a sealing band 133 that is operatively coupled to the ring 131. In the illustrated embodiment, the sealing band 133 and the ring 131 have circular shapes that are concentric with the longitudinal axis 190. The ring 131 includes an inner surface 232 and an outer surface 234. The sealing band 133 includes an inner surface 242 and an outer surface 244. As shown, the ring 131 and the sealing band 133 are operatively coupled to each other by radial supports 248. The radial supports 248 project from the outer surface 234 of the ring 131 to the inner surface 242 of the band 133. The radial supports 248 may be distributed about the longitudinal axis 190. For example, as shown in FIG. 4, the radial supports 248 are evenly distributed about the longitudinal axis 190. Each radial support 248 is separated from adjacent radial supports by a gap $G_2$ having an arcuate length $L_2$. In some embodiments, the arcuate length $L_2$ is substantially greater than the arcuate length $L_1$ (FIG. 3) of the grip members 150 (FIG. 3). Also shown, the outer surface 244 of the band 133 may have knurling to facilitate an operator gripping the collar 130.

The ring 131, sealing band 133, and the radial supports 248 may be integrally formed (e.g., machined or molded) or may be assembled from separate parts.

Figure 5:
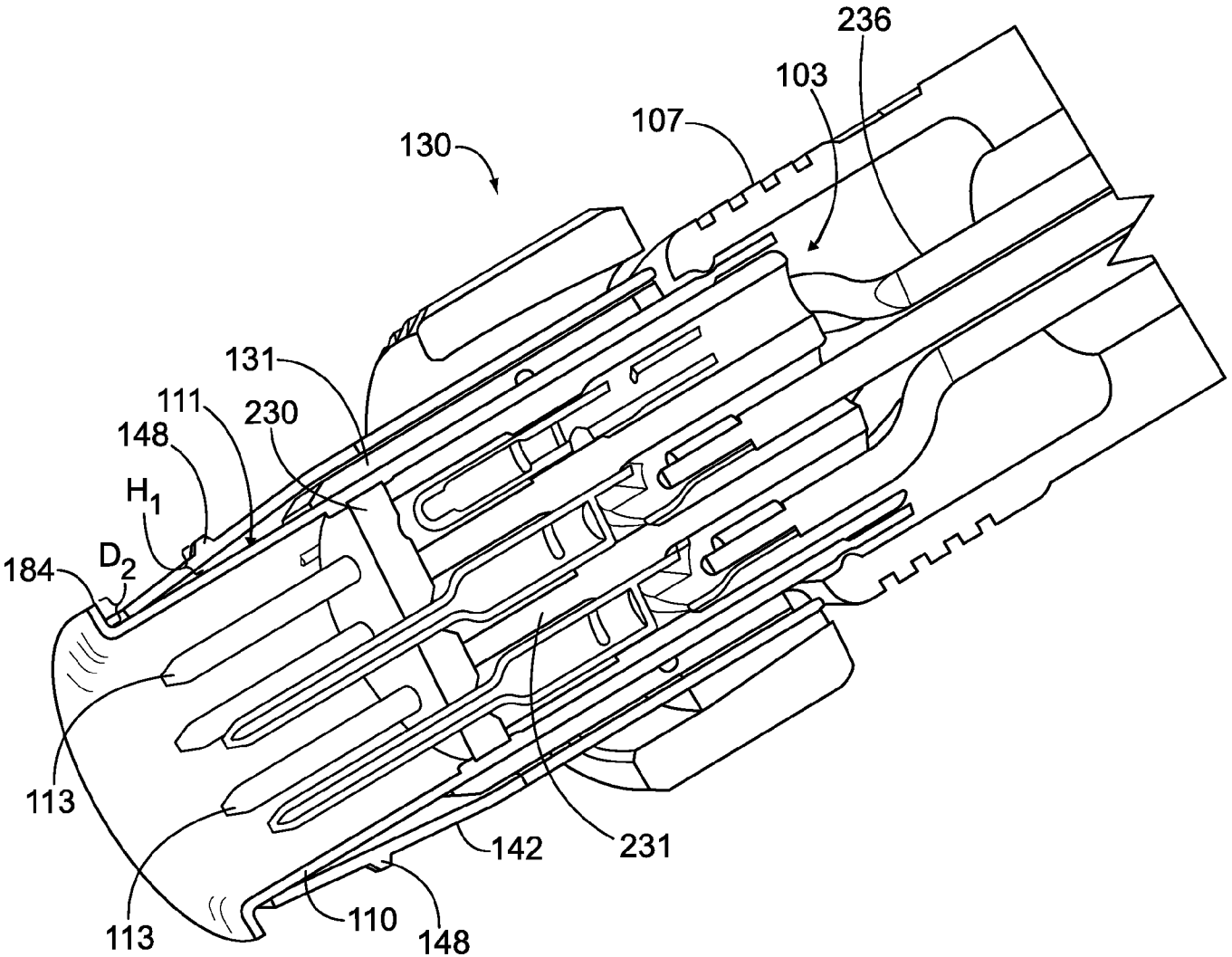
FIG. 5 is a cross-sectional view of the connector assembly while unengaged with the mating connector.
Figure 6:
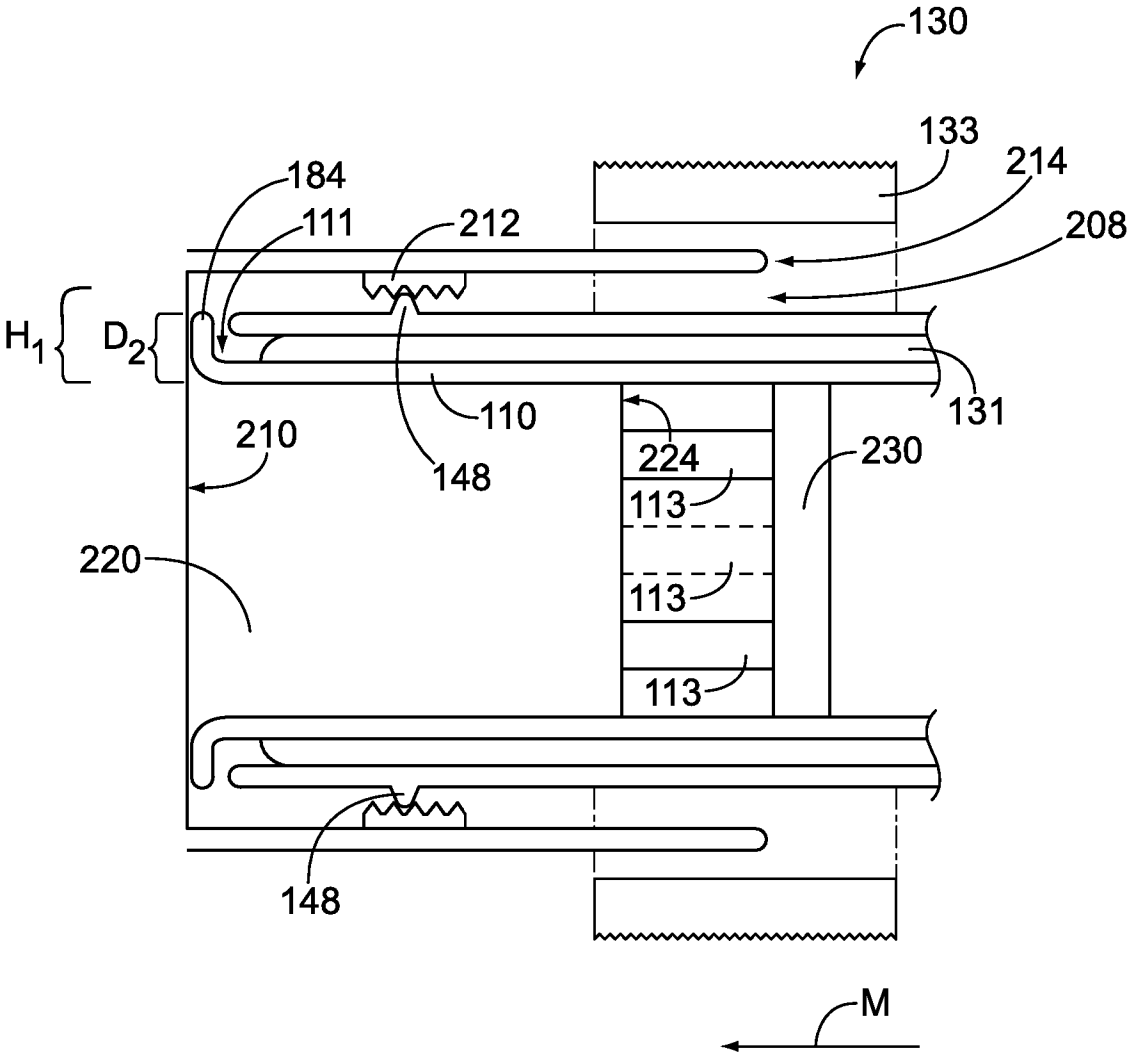
FIG. 6 is a partial cross-sectional view of the connector assembly and mating connector engaged with each other.

FIG. 5 is a partial cross-sectional view of the connector assembly 102 while unengaged with the mating connector 104, and FIG. 6 is a partial cross-sectional view of the connector assembly 102 (FIG. 1) and mating connector 104 (FIG. 2) while engaged with each other. The collar 130 and the ring 131 are in the withdrawn position in FIG. 5 and are in the locked position in FIG. 6. As shown, the connector assembly 102 includes a positioner 230 and a contact insert 231 (FIG. 5) that are held within the plug body 110. The positioner 230 and the contact insert 231 may include a dielectric material and may be configured to hold the mating contacts 113 in a predetermined arrangement. Also shown, the boot 107 (FIG. 5) may form a passage for electrical and/or fiber optic cables 236 (FIG. 5) from the cable assembly 106 (FIG. 1) to extend therethrough.

As shown in FIGS. 5 and 6, the lip 184 projects a distance $D_2$ radially outward from the outer surface 111 of the plug body 110. Furthermore, the fingers 146 may have a maximum height $H_1$ away from the outer surface 111. For example, the maximum height $H_1$ may extend from the outer surface 111 to a tip of the thread element 148. The maximum height $H_1$ may be less than or substantially equal to the distance $D_2$. As such, when the mating end 105 is inserted into the cavity 208 (FIG. 6) of the mating connector 104, the fingers 146 may clear the front edge 214 (FIG. 6) of the mating connector 104 without the thread elements 148 catching or snagging the front edge 214.

To construct the connector assembly 102, the sleeve member 142 (FIG. 5) may be inserted over the plug body 110 such that the sleeve member 142 surrounds the plug body 110 about the longitudinal axis 190 (FIG. 1). The ring 131 may then be inserted into a space between the plug body 110 and sleeve member 142 such that the ring 131 is positioned between the sleeve member 142 and the outer surface 111 of the plug body 110. As such, the sleeve member 142 may be slidably mounted over the outer surface 234 (FIG. 4) of the ring 131. When the collar 130 is inserted over the plug body 110 and the sleeve member 142, each gap $G_2$ (FIG. 4) between adjacent radial supports 248 may receive a corresponding grip member 150. In one embodiment, the arcuate length $L_1$ of the grip members 150 is less than the arcuate length $L_2$ of the gap $G_2$. As such, the sleeve member 142 may be rotated slightly about the longitudinal axis 190. The slight rotation may allow the sleeve member 142 to adjust if the thread elements 148 and the threads 212 are not precisely aligned. Alternatively, the arcuate lengths $L_1$ and $L_2$ may be substantially equal and the grip members 150 may form an interference fit with the gaps $G_2$ when the connector assembly 102 is fully constructed. Furthermore, the sleeve member 142 may not have grip members 150.

After the plug body 110, the sleeve member 142, and the collar 130 are positioned relative to each other as shown in FIG. 5, the mating contacts 113, the positioner 230, and the contact insert 231 may be inserted into the loading end 103 of the plug body 110 and the boot 107 may slide over the cables 236 and be coupled to the loading end 103 of the plug body 110. However, the preceding description of constructing the connector assembly 102 is just one example, and there may be alternative methods for constructing embodiments of the connector assemblies described herein.

When the connector assembly 102 is fully constructed, the collar 130 is movable in the axial direction along the outer surface 111 of the plug body 110. To engage the connector assembly 102 and the mating connector 104, the mating end 105 of the plug body 110 is inserted through the opening 216 (FIG. 1) and advanced into the cavity 208. The plug body 110 and/or the inner surface 218 may have grooves, keys, or other features for facilitating proper alignment of the plug body 110 with respect to the plug insert 220. When the lip 184 of the plug body 110 engages the contact base 210 within the cavity 208 and/or when the mating face 224 of the plug insert 220 engages the positioner 230, the collar 130 may continue to advance in the axial direction as indicated by the arrow M in FIG. 6. In some embodiments, the sleeve member 142 may initially slide in the axial direction with the collar 130 until the distal ends 149 of the fingers 146 engage the lip 184. As the collar 130 continues to move along the plug body 110 in the axial direction, each radial support 248 (FIG. 4) may slide between adjacent grip members 150 within the corresponding cut-out 151. The ring 131 engages the inner surface 143 (FIG. 3) of the fingers 146 causing the fingers 146 to resiliently flex outward away from the outer surface 111. In the illustrated, the fingers 146 flex toward the inner surface 218 (FIG. 2) and the thread elements 148 engage the threads 212. If the thread elements 148 and corresponding threads 212 are not precisely aligned to mate with each other, forces created by an improper fitting may slightly adjust the rotational position and/or the axial position of the sleeve member 142 on the ring 131. As shown in FIG. 6, when the connector assembly 102 and the mating connector 104 are fully engaged, the sealing band 133 may surround the front edge 214 of the stem wall 204. When fully engaged, the fingers 146 and the sleeve member 142 may form an electrical shield for the connection extending therethrough, and the connector assembly 102 may form an environmental seal with the mating connector 104.

To remove the connector assembly 102, the collar 130 may be moved to the withdrawn position. When the ring 131 is retracted, the fingers 146 flex inward toward the longitudinal axis 190 thereby disengaging the thread elements 148 from the threads 212. The mating end 105 of the connector assembly 102 may then be removed from the cavity 208. Thus, in the illustrated embodiment, the connector assembly 102 includes three concentric parts (i.e., the plug body 110, the ring 131, and the sleeve member 142), which are slidably mounted to each other. The parts may move alongside each other to engage/disengage with the mating connector 104.

Figure 7:
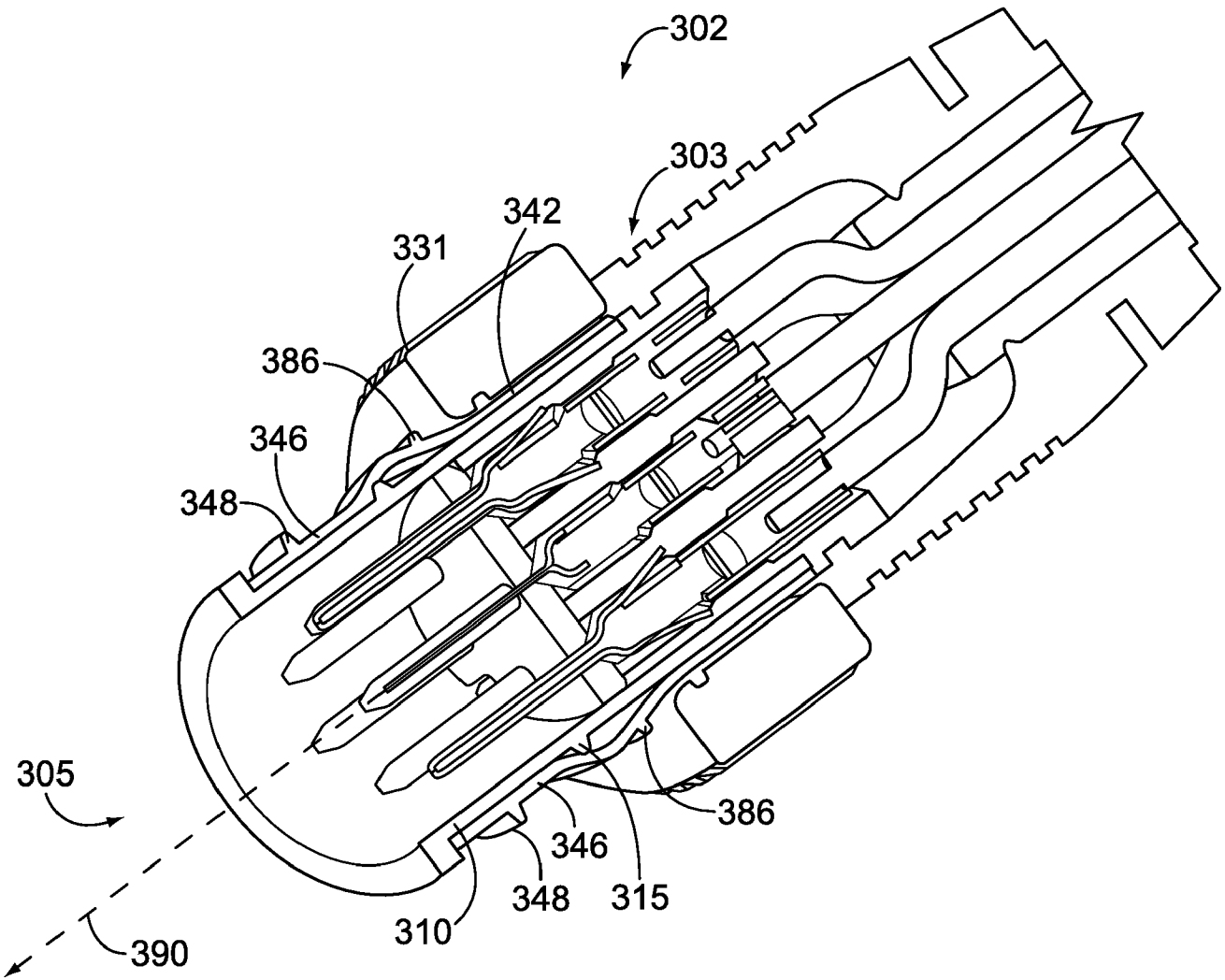
FIG. 7 is a cross-sectional view of a connector assembly Formed in accordance with another embodiment.
Figure 8:
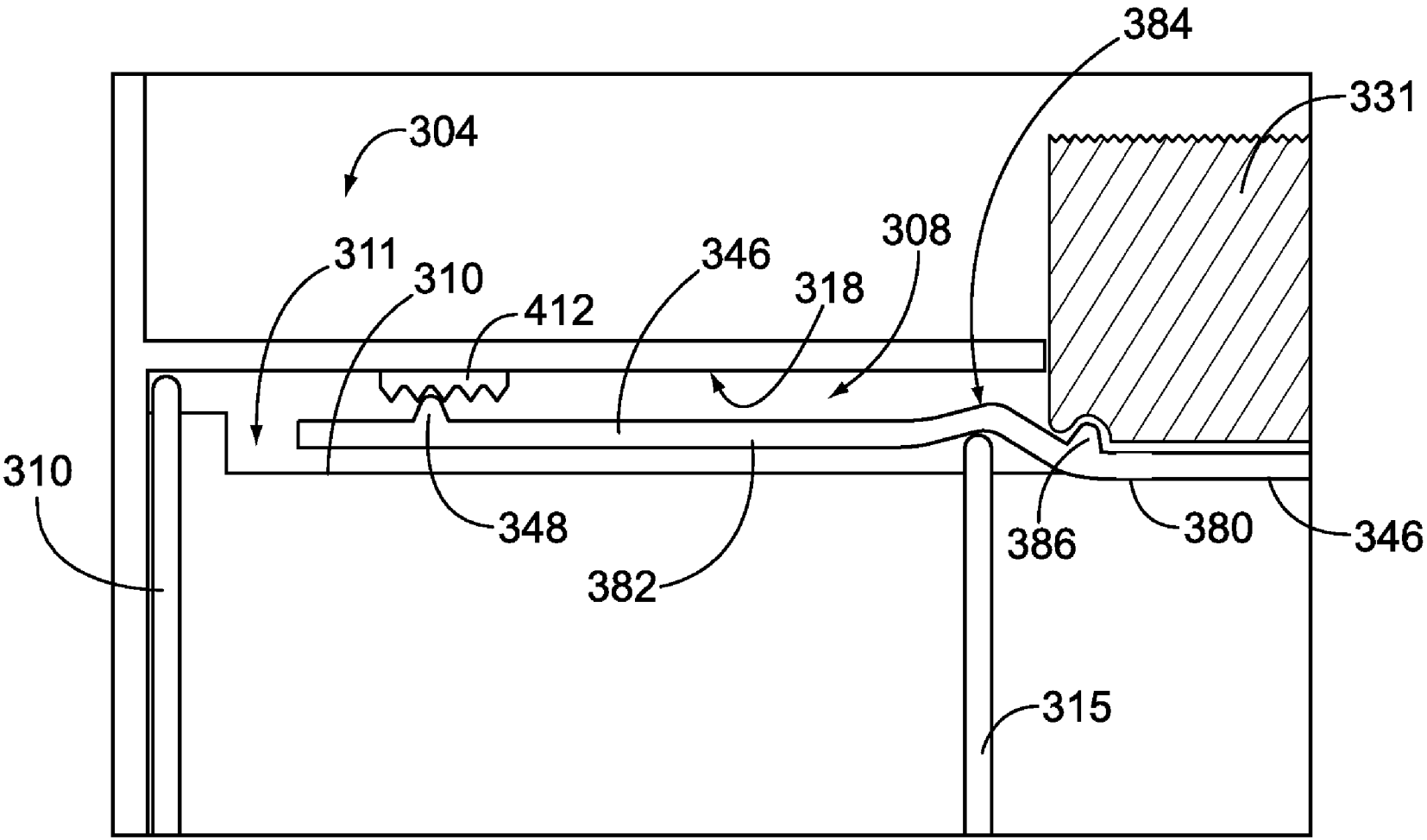
FIG. 8 is a partial cross-sectional view of the connector assembly and a mating connector engaged with each other.

FIGS. 7 and 8 illustrate a connector assembly 302 (FIG. 7) formed in accordance with another embodiment. As shown, the connector assembly 302 may be a male push-pull connector and have similar features and components as the connector assembly 102 described above. The connector assembly 302 is configured to sealably engage with a mating connector 304 (shown in FIG. 8) that may have similar features and components as described above with respect to the mating connector 104. The connector assembly 302 includes a plug body 310 having loading and mating ends 303 and 305, respectively, and a longitudinal axis 390 (FIG. 7) extending therebetween. The mating end 305 is configured to be inserted into a cavity 308 (FIG. 8) of the mating connector 304 to establish at least one of a communicative and power connection. The plug body 310 has an outer surface 311 (FIG. 8) and a ridge 315 that projects radially outward from the outer surface 311. The ridge 315 may extend entirely along the outer surface 311 around the longitudinal axis 390 (i.e., extend circumferentially around the plug body). The ridge 315 is configured to operate as a fulcrum that interacts with a corresponding finger 346 as will be described in more detail below. In alternative embodiments, there are a plurality of ridges that extend circumferentially around the plug body 310. In such embodiment, each ridge engages with a corresponding finger 346 as described below.

Also shown, the connector assembly 302 includes a sleeve member 342 that surrounds the plug body 310. The sleeve member 342 includes a plurality of fingers 346 that extend in the axial direction along the outer surface 311 of the plug body 310 and toward the mating end 305. Each finger 346 extends over the ridge 315 and includes a base portion 380 on one side of the ridge 315 that is proximate to the loading end 303, a lever portion 382 on another side of the ridge 315 that is proximate to the mating end 305, and a transition portion 384 that extends directly over the ridge 315 and joins the base and lever portions 380 and 382. The connector assembly 302 also includes a ring 331 that surrounds the plug body 310 and the sleeve member 342. The ring 331 is configured to slide along an outer surface of the sleeve member 342 in the axial direction between withdrawn and locked positions. FIG. 7 shows the ring 331 in a withdrawn position, and FIG. 8 shows the ring 331 in the locked position.

When the ring 331 is moved from the withdrawn position to the locked position, the ring 331 compresses the base portion 380 of each finger 346. The fingers 346 move toward the outer surface 311 of the plug body 310. The fingers 346 press against the ridge 315 causing the lever portions 382 of the fingers 346 to flex away from the outer surface 311 and engage the inner wall surface 318 of the mating connector 304. More specifically, the base portion 380 and/or the transition portion 384 presses against the ridge 315 generating leverage to move the lever portion 382 away from the outer surface 311.

As shown in FIG. 8, the transition portion 384 is raised above the ridge 315 on the side of the loading end 303, then extends downward toward the outer surface 311 such that the transition portion 384 is sloping downward and engages a side of the ridge 315 that is facing the mating end 305. In the illustrated embodiment, because the transition portion 384 is higher than the ridge 315 on the side facing the loading end 303, the finger 346 may generate more leverage for raising the lever portion 382.

Also shown, each finger 346 may include a thread element 348 that projects therefrom and is configured to engage threads 412 within the cavity 308 of the mating connector 304. Furthermore, in the illustrated embodiment, the lever portion 382 of each finger 346 may be biased toward the outer surface 311. In some embodiments, the lever portion 382 directly abuts the outer surface 311 of the plug body 310 when the ring is in the withdrawn position.

Also shown in FIGS. 7 and 8, each finger 346 may include a projection 386 located on the base portion 380 that extends radially outward therefrom. The ring 331 may have a channel 388 that extends around the sleeve member 342. As shown in FIG. 8, when the ring 331 is moved into the locked position, the projection 386 may form an interference fit with the channel 388. As such, the projection(s) 386 and the channel 388 may facilitate holding tile ring 331 in position such that the ring 331 is not inadvertently moved from the locked position. In alternative embodiments, the ring 331 may include a plurality of channels that extend around the ring 331 where each of the channels is configured to engage one projection 386.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a plug body having loading and mating ends and a central axis extending therebetween, the mating end being configured to be inserted into a cavity of a mating connector to establish at least one of communicative and power connections, the plug body having an outer surface that surrounds and faces away from the central axis;

a ring slidably mounted over the plug body, the ring configured to slide along the outer surface of the plug body in an axial direction between withdrawn and locked positions; and a sleeve member slidably mounted over the ring and being rotatably adjustable about the central axis with respect to the plug body, the sleeve member comprising fingers that extend toward the mating end and are biased inward toward the outer surface of the plug body, the ring engaging the fingers when moved from the withdrawn position to the locked position causing the fingers to flex outward away from the outer surface and engage the mating connector, the sleeve member rotating about the central axis to correct for rotational misalignment of the fingers relative to the mating connector.

2. The connector assembly in accordance with claim 1 further comprising a sealing band that surrounds the sleeve member about the central axis, the sealing band and the ring being operatively coupled to each other, wherein the sleeve member slides between the ring and the sealing band when the ring is moved from the withdrawn position to the locked position.

3. The connector assembly in accordance with claim 1 wherein the fingers comprise numerous fingers that are separated from each other by thin slits, the fingers forming a substantially cylindrical structure that extends along an inner wall surface of the cavity to form an electrical shield.

4. The connector assembly in accordance with claim 1 wherein the plug body defines a cavity having a plurality of mating contacts therein, the mating contacts being configured to be inserted into contact channels of the mating connector, the sleeve member being rotatably adjustable with respect to the mating contacts.

5. The connector assembly in accordance with claim 1 wherein each finger includes a thread element that projects radially outward, the thread element configured to engage corresponding threads of the inner wall surface of the mating connector when the finger is pressed against the inner wall surface, the sleeve member being rotatably adjustable about the central axis to correct for rotational misalignment of the thread elements of the fingers relative to the corresponding threads of the mating connector.

6. The connector assembly in accordance with claim 5 wherein the thread element has an axial position measured relative to the central axis, the axial position of the thread element on one finger being different from the axial position of the thread element on an adjacent finger.

7. The connector assembly in accordance with claim 5 wherein the thread element includes at least one tooth configured to engage threads of the mating connector.

8. The connector assembly in accordance with claim 5 wherein the thread element on one finger comprises a plurality of thread elements.

9. The connector assembly in accordance with claim 1 wherein the sleeve member is stamped and formed from a common piece of sheet material, the sheet material having a substantially uniform thickness.

10. A connector assembly comprising:

a plug body having loading and mating ends and a central axis extending therebetween, the mating end being configured to be inserted into a cavity of a mating connector to establish at least one of communicative and power connections, the plug body having an outer surface and a ridge that projects radially outward from the outer surface;

a sleeve member mounted over the plug body, the sleeve member comprising fingers that extend in the axial direction along the outer surface of the plug body and toward the mating end, each finger extending over the ridge and comprising a base portion on one side of the ridge that is proximate to the loading end and a lever portion on another side of the ridge that is proximate to the mating end; and a ring slidably mounted over the sleeve member, the ring configured to slide along the sleeve member in the axial direction between withdrawn and locked positions, the ring compressing the base portions of the fingers inward toward the outer surface of the plug body when moved from the withdrawn position to the locked position, the fingers pressing against the ridge causing the lever portions of the fingers to flex away from the outer surface and engage the mating connector.

11. The connector assembly in accordance with claim 10 wherein the lever portions of the fingers are biased toward the outer surface.

12. The connector assembly in accordance with claim 10 wherein each finger has a projection that extends radially outward therefrom and the ring has a channel that extends around the sleeve member, the projection of each finger forming an interference fit with the channel when the ring is in the locked position.

13. The connector assembly in accordance with claim 10 wherein the ridge extends completely around the outer surface of the plug body.

14. The connector assembly in accordance with claim 10 wherein plug body includes a lip that is proximate to the mating end, the lip projecting radially outward from the outer surface of the plug body.

15. The connector assembly in accordance with claim 10 wherein each finger includes at least one thread element that projects radially outward, the at least one thread element configured to engage the wall surface when the finger is pressed against the wall surface.

16. The connector assembly in accordance with claim 15 wherein the at least one thread element has an axial position along the corresponding finger, the axial position(s) of the at least one thread element on one finger being different from the axial position(s) of the at least one thread element on an adjacent finger.

17. The connector assembly in accordance with claim 10 wherein the base portion of each finger projects away from the outer surface of the plug as the base portion extends in the axial direction.

18. The connector assembly in accordance with claim 10 wherein the lever portion directly abuts the outer surface of the plug body when the ring is in the withdrawn position.

19. A connector assembly comprising:

a plug body having loading and mating ends and a central axis extending therebetween, the mating end being configured to be inserted into a cavity of a mating connector to establish at least one of communicative and power connections, the plug body having an outer surface that surrounds and faces away from the central axis;

a ring slidably mounted over the plug body, the ring configured to slide along the outer surface of the plug body in an axial direction between withdrawn and locked positions; and a sleeve member slidably mounted over the ring, the sleeve member comprising a base portion and fingers that extend from the base portion toward the mating end, the sleeve member having a first diameter measured at the base portion and a second diameter measured at distal ends of the fingers when the fingers are in a relaxed state, wherein the fingers are biased inward such that the first diameter is greater than the second diameter and the fingers extend toward the central axis and the outer surface of the plug body when the ring is in the withdrawn position and the fingers are in the relaxed state, the ring engaging the fingers when moved from the withdrawn position to the locked position causing the fingers to flex outward away from the outer surface and engage the mating connector.

20. The connector assembly in accordance with claim 19, wherein the fingers include thread elements that project radially outward therefrom to define a maximum height of the fingers from the outer surface of the plug body when the ring is in the withdrawn position and the fingers are biased inward in the relaxed state, the plug body including a lip that is proximate to the mating end and projects a radial distance away from the outer surface of the plug body, wherein the maximum height is less than or substantially equal to the radial distance.

* * * * *